US005794819A

United States Patent [19]

Smith

[11] Patent Number: 5,794,819

[45] Date of Patent: Aug. 18, 1998

[54] DUAL-COMPARTMENT BOTTLE SYSTEM

[76] Inventor: Trevor A. Smith, #3 Riley St, High River, Alberta, Canada, T1V-1G5

[21] Appl. No.: 696,039

[22] Filed: Aug. 13, 1996

[51] Int. Cl.[6] ..... B67D 5/56

[52] U.S. Cl. ..... 222/129; 222/94; 222/485; 220/525

[58] Field of Search ..... 222/94, 129, 484, 222/485, 556; 220/525

[56] References Cited

U.S. PATENT DOCUMENTS

| | | | |
|---|---|---|---|
| 2,939,610 | 6/1960 | Castelli et al. | 222/94 |
| 4,271,984 | 6/1981 | Ducros et al. | 222/94 |
| 5,503,309 | 4/1996 | Oder et al. | 222/556 X |
| 5,588,550 | 12/1996 | Meyer | 220/525 |

FOREIGN PATENT DOCUMENTS

| | | | |
|---|---|---|---|
| 621200 | 10/1994 | European Pat. Off. | 222/129 |

*Primary Examiner*—Joseph Kaufman

[57] ABSTRACT

A dual compartment bottle system for dispensing of two separate products, such as shampoo and conditioner, from within one convenient bottle which separates the two separate products. The device includes a substantially cylindrical bottle including a vertical partition which creates two distinct compartments, and a threaded dispensing cap secured to a threaded neck of the cylindrical bottle. The threaded dispensing cap having two passages, one passage into each separate compartment, such that a user can separately dispense the desired product without contamination from the other product within the cylindrical bottle.

15 Claims, 4 Drawing Sheets

FIG. 3
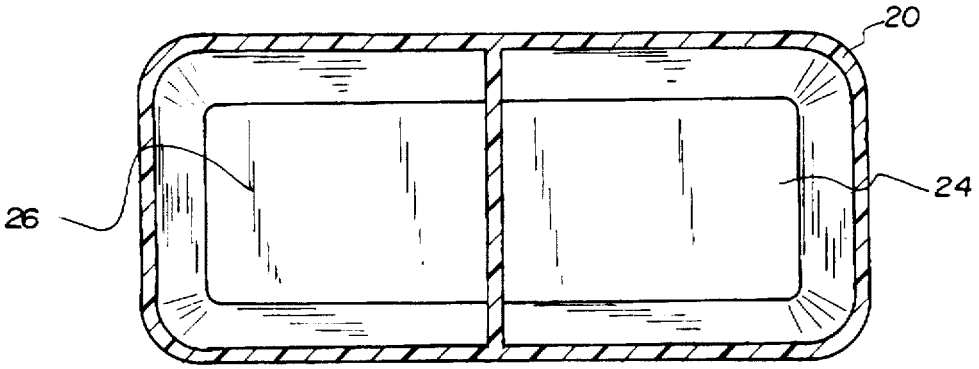
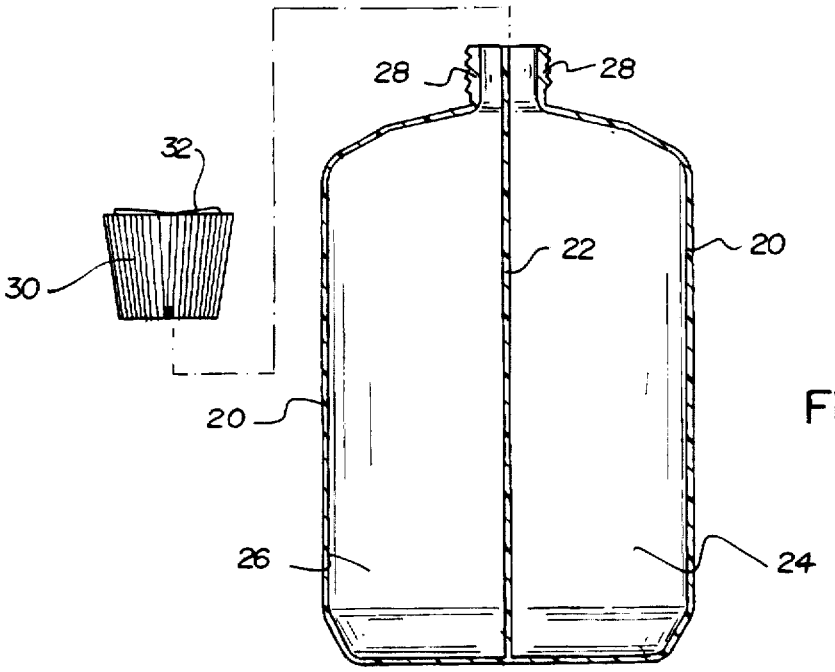
FIG. 4

DUAL-COMPARTMENT BOTTLE SYSTEM

BACKGROUND OF THE INVENTION

1. Field of the Invention

The present invention relates to Bottle Devices and more particularly pertains to a new Dual-Compartment Bottle System for dispensing of two separate products, such as shampoo and conditioner, from within one convenient bottle which separates said two separate products.

2. Description of the Prior Art

The use of Bottle Devices is known in the prior art. More specifically, Bottle Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Bottle Devices include U.S. Pat. No. 5,332,112; U.S. Pat. No. 4,279,349; U.S. Pat. No. 4,984,715; U.S. Pat. No. 5,348,548; U.S. Design Pat. No. 345,302 and U.S. Design Pat. No. 324,173.

While these devices fulfill their respective, particular objectives and requirements, the aforementioned patents do not disclose a new Dual-Compartment Bottle System. The inventive device includes a substantially cylindrical bottle including a vertical partition which creates two distinct compartments, and a threaded dispensing cap secured to a threaded neck of the cylindrical bottle providing the means for the user to separately dispense the desired product without contamination from the other product within the cylindrical bottle.

In these respects, the Dual-Compartment Bottle System according to the present invention substantially departs from the conventional concepts and designs of the prior art, and in so doing provides an apparatus primarily developed for the purpose of dispensing of two separate products, such as shampoo and conditioner, from within one convenient bottle which separates said two separate products.

SUMMARY OF THE INVENTION

In view of the foregoing disadvantages inherent in the known types of Bottle Devices now present in the prior art, the present invention provides a new Dual-Compartment Bottle System construction wherein the same can be utilized for dispensing of two separate products, such as shampoo and conditioner, from within one convenient bottle which separates said two separate products.

The general purpose of the present invention, which will be described subsequently in greater detail, is to provide a new Dual-Compartment Bottle System apparatus and method which has many of the advantages of the Bottle Devices mentioned heretofore and many novel features that result in a new Dual-Compartment Bottle System which is not anticipated, rendered obvious, suggested, or even implied by any of the prior art Bottle Devices, either alone or in any combination thereof.

To attain this, the present invention generally comprises a substantially cylindrical bottle including a vertical partition which creates two distinct compartments, and a threaded dispensing cap secured to a threaded neck of the cylindrical bottle providing the means for the user to separately dispense the desired product without contamination from the other product within the cylindrical bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Dual-Compartment Bottle System apparatus and method which has many of the advantages of the Bottle Devices mentioned heretofore and many novel features that result in a new Dual-Compartment Bottle System which is not anticipated, rendered obvious, suggested, or even implied by any of the prior art Bottle Devices, either alone or in any combination thereof.

It is another object of the present invention to provide a new Dual-Compartment Bottle System which may be easily and efficiently manufactured and marketed.

It is a further object of the present invention to provide a new Dual-Compartment Bottle System which is of a durable and reliable construction.

An even further object of the present invention is to provide a new Dual-Compartment Bottle System which is susceptible of a low cost of manufacture with regard to both materials and labor, and which accordingly is then susceptible of low prices of sale to the consuming public, thereby making such Dual-Compartment Bottle System economically available to the buying public.

Still yet another object of the present invention is to provide a new Dual-Compartment Bottle System which provides in the apparatuses and methods of the prior art some of the advantages thereof, while simultaneously overcoming some of the disadvantages normally associated therewith.

Still another object of the present invention is to provide a new Dual-Compartment Bottle System for dispensing of two separate products, such as shampoo and conditioner, from within one convenient bottle which separates said two separate products.

Yet another object of the present invention is to provide a new Dual-Compartment Bottle System which includes a substantially cylindrical bottle including a vertical partition which creates two distinct compartments, and a threaded dispensing cap secured to a threaded neck of the cylindrical bottle providing the means for the user to separately dispense the desired product without contamination from the other product within the cylindrical bottle.

Still yet another object of the present invention is to provide a new Dual-Compartment Bottle System that is easier to transport than conventional shampoo and conditioner bottle sets.

Even still another object of the present invention is to provide a new Dual-Compartment Bottle System that is refillable thereby producing less waste and less plastic is thereby utilized.

Still another object of the present invention is to provide a new Dual-Compartment Bottle System that prevents the user from having to switch to products containing shampoo and condition mixed together fluidly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1 disclosing the first and second compartments.

FIG. 4 is a cross sectional view taken along line 4—4 of FIG. 2.

DESCRIPTION OF THE PREFERRED EMBODIMENT

Figure 1:
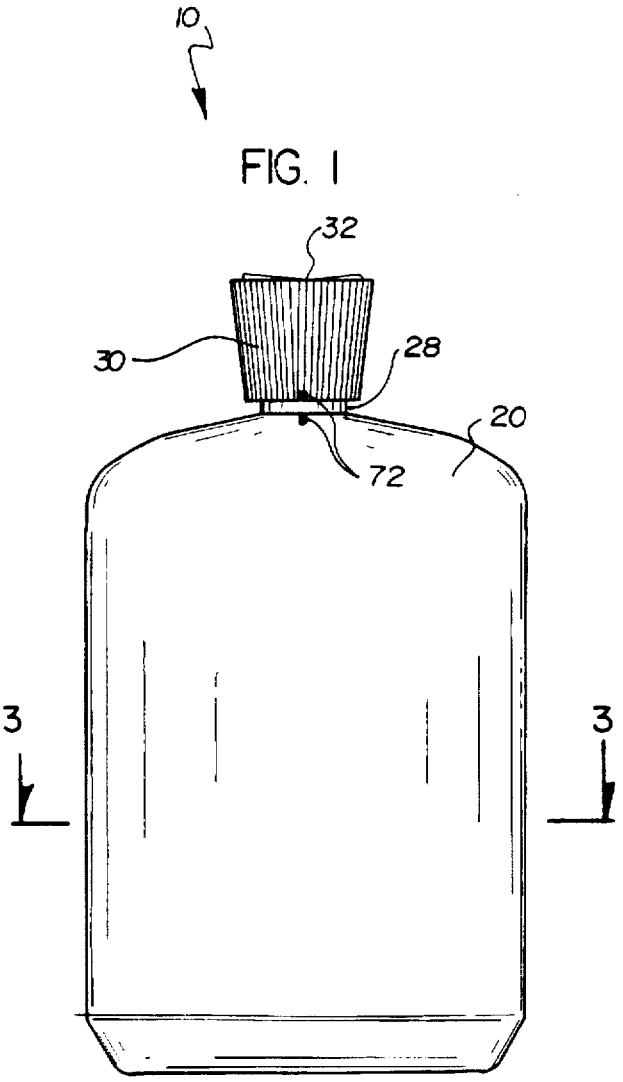
FIG. 1 is a front view of a new Dual-Compartment Bottle System according to the present invention.

With reference now to the drawings, and in particular to FIGS. 1 through 8 thereof, a new Dual-Compartment Bottle System embodying the principles and concepts of the present invention and generally designated by the reference numeral 10 will be described.

More specifically, it will be noted that the Dual-Compartment Bottle System 10 comprises a substantially cylindrical bottle 20 including a vertical partition 22 separating a first compartment 24 and a second compartment 26 which both dispense through a threaded neck 28 of the cylindrical bottle 20, and a threaded dispensing cap 30 rotatably secured to the threaded neck 28 thereby selectively dispensing fluids from a desired compartment within the cylindrical bottle 20.

Figure 2:
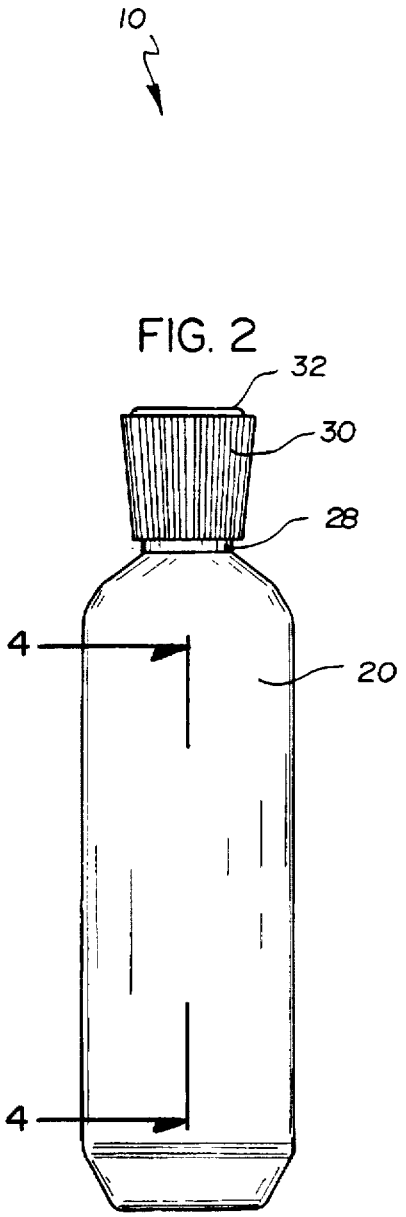
FIG. 2 is a side view thereof.
Figure 5:
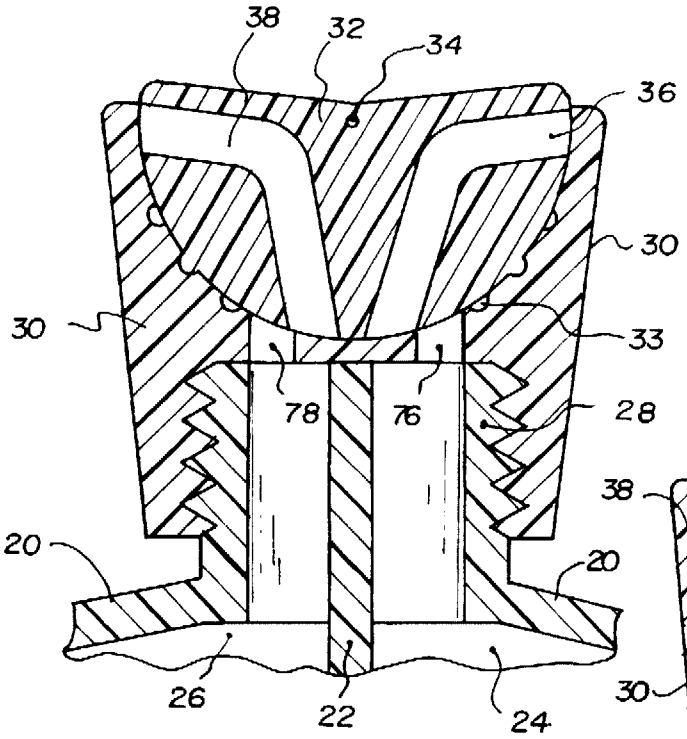
FIG. 5 is a cross sectional view of the semi-spherical pivoting cap pivotally attached within the threaded dispensing cap in the closed position for the first and second compartments.
Figure 6:
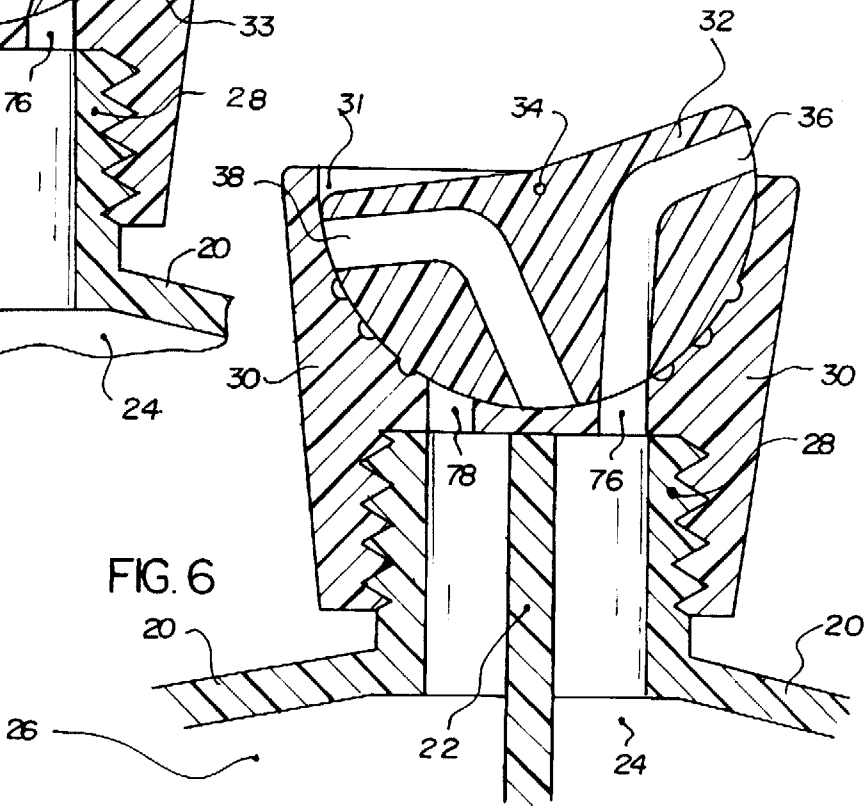
FIG. 6 is a cross sectional view of the semi-spherical pivoting cap pivotally attached within the threaded dispensing cap in the open position for the second compartment and the closed position for the first compartment.
Figure 7:
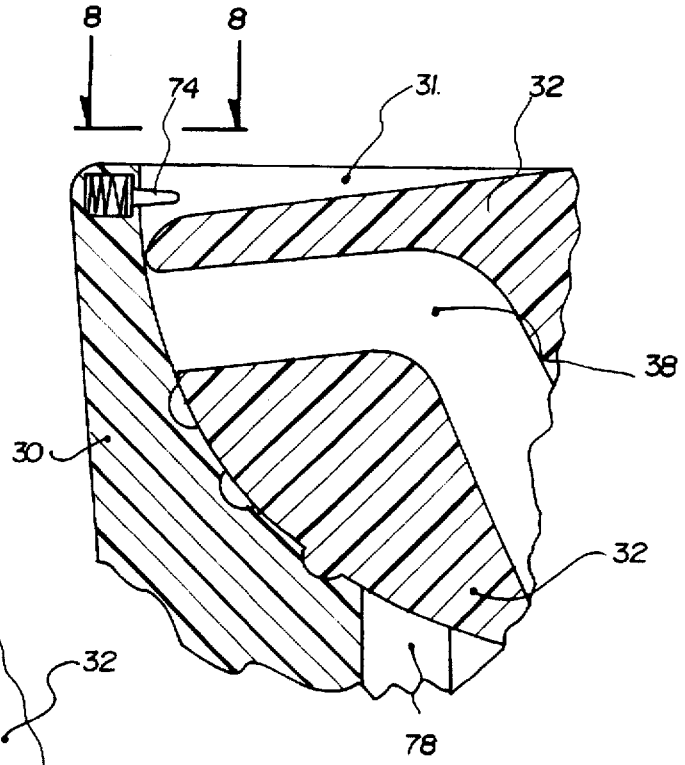
FIG. 7 is a magnified cross sectional view of the threaded dispensing cap containing a spring positioned pin.
Figure 8:
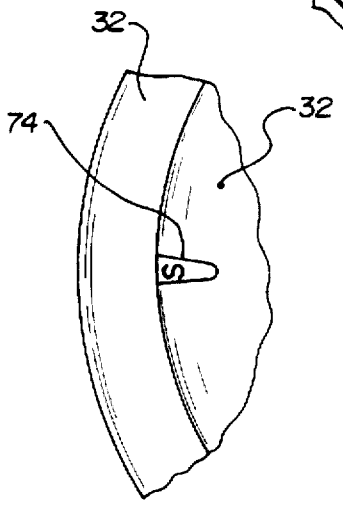
FIG. 8 is a magnified top view of the threaded dispensing cap displaying the spring positioned pin.

As best illustrated in FIGS. 1 through 8, it can be shown that the threaded dispensing cap 30 includes a semi-spherical cavity 31 projecting into the cornice. The threaded dispensing cap 30 includes a first passage 76 projecting from the bottom surface into the semi-spherical cavity 31 and a second passage 78 projecting from the bottom surface opposite of the first passage 76 and then projecting into the semi-spherical cavity 31 as best disclosed in FIGS. 5–6. The threaded dispensing cap 30 includes a semi-spherical pivoting cap 32 formed to the shape of the semi-spherical cavity 31. The semi-spherical pivoting cap 32 is pivotally secured to the threaded dispensing cap 30 within the semi-spherical cavity 31 by an axle pin 34 projecting through the upper portions of the threaded dispensing cap 30 and the semi-spherical pivoting cap 32 as shown in FIGS. 5–6. The threaded dispensing cap 30 includes at least three positioning notches 33 radially projecting into the wall of the semi-spherical cavity 31 as best shown in FIGS. 5–7 of the drawings. The semi-spherical pivoting cap 32 includes a positioning member 35 releasably captured by the positioning notches 33 thereby positioning the semi-spherical pivoting cap 32 flush to the cornice of the threaded dispensing cap 30 or pivoted to either side about the axle pin 34. The semi-spherical pivoting cap 32 includes a first L-shaped passage 36 projecting from one side of the central lower radial portion to the edge near the cornice. The semi-spherical pivoting cap 32 further includes a second L-shaped passage 38 projecting from the central lower radial portion opposite of the first L-shaped passage 36 then projecting to the edge opposite of the first L-shaped passage 36 near the cornice as shown in FIGS. 5–6 of the drawings. The first L-shaped passage 36 receives fluid from the first compartment 24 through the first passage 76 when the semi-spherical pivoting cap 32 is pivoted so as to align the first L-shaped passage 36 with the first passage 76. As shown in FIG. 7 of the drawings, the second L-shaped passage 38 receives fluid from the second compartment 26 through the second passage 78 when the semi-spherical pivoting cap 32 is pivoted so as to align the second L-shaped passage 38 with the second passage 78. Preferably as shown in FIG. 1 of the drawings, a cap aligning line 72 is vertically secured to the lower portion of the threaded dispensing cap 30, and another corresponding cap aligning line 72 is vertically secured to the upper portion of the cylindrical bottle 20 so as to position the first and second passages 76, 78 with their respective first and second compartments 24, 26 when aligned. As shown in FIGS. 7–8 of the drawings, the threaded dispensing cap 30 includes a spring positioned pin 74 near the cornice projecting horizontally from within the semi-spherical cavity 31 when the semi-spherical pivoting cap 32 is pressed downwardly on one side. The spring positioned pin 74 contains indicia of the fluid contained on the respective compartment and which springably projects back into the threaded dispensing cap 30 upon closing the respective compartment. There is another corresponding spring positioned pin 74 on the opposite side indicating the fluid being dispensed. Preferably, the cylindrical bottle 20 is swaged forming an oblong shape allowing maximum convenience during transportation as best shown in FIGS. 1 and 2 of the drawings.

In use, the user presses the desired side of the semi-spherical pivoting cap 32 thereby aligning the respective L-shaped passage 36 or 38 with the respective passage 76 or 78. The user then contracts the sides of the cylindrical bottle 20 while simultaneously positioning said cylindrical bottle 20 in a substantially inverted position. The desired fluid flows from the desired compartment 24 or 26 through the respective passage 76 or 78 then dispensing outwardly through the respective L-shaped passage 36 or 38 for utilization by the user. When finished the user presses the opposite side of the semi-spherical pivoting cap 32 so as to make flush the cornice of the semi-spherical pivoting cap 32 with the cornice of the threaded dispensing cap 30. When the semi-spherical pivoting cap 32 is pivoted to either the first or second sides, the opposite side containing a separate fluid can not be dispensed because the respective L-shaped passage does not align with the respective passage within the threaded dispensing cap 30 thereby preventing the accidental mixing of the two separate and distinct fluids within the cylindrical bottle 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dual-compartment bottle system comprising:

a substantially cylindrical bottle including a vertical partition separating a first compartment and a second compartment which both dispense through a threaded neck of the cylindrical bottle: and a threaded dispensing cap rotatably secured to the threaded neck thereby selectively dispensing fluids from a desired compartment within the cylindrical bottle; and wherein the threaded dispensing cap includes a semi-spherical cavity projecting into a top of the threaded dispensing cap, a first passage projecting from the bottom surface into the semi-spherical cavity, and a second passage projecting from the bottom surface opposite of the first passage and then projecting into the semi-spherical cavity.

2. The dual-compartment bottle system of claim 1, wherein the threaded dispensing cap includes a semi-spherical pivoting cap formed to the shape of the semi-spherical cavity and where the semi-spherical pivoting cap is pivotally secured to the threaded dispensing cap within the semi-spherical cavity by an axle pin projecting through the upper portions of the threaded dispensing cap and the semi-spherical pivoting cap.

3. The dual-compartment bottle system of claim 2, wherein the threaded dispensing cap includes at least three positioning notches radially projecting into the wall of the semi-spherical cavity, and the semi-spherical pivoting cap includes a positioning member releasably captured by the positioning notches thereby positioning the semi-spherical pivoting cap flush to the top of the threaded dispensing cap or pivoted to either side about the axle pin.

4. The dual-compartment bottle system of claim 3, wherein the semi-spherical pivoting cap includes a first L-shaped passage projecting from one side of the central lower radial portion to the edge near the top of the threaded dispensing cap, and a second L-shaped passage projecting from the central lower radial portion opposite of the first L-shaped passage then projecting to the edge opposite of the first L-shaped passage near the top of the threaded dispensing cap, and where the first L-shaped passage receives fluid from the first compartment through the first passage when the semi-spherical pivoting cap is pivoted so as to align the first L-shaped passage with the first passage and where the second L-shaped passage receives fluid from the second compartment through the second passage when the semi-spherical pivoting cap is pivoted so as to align the second L-shaped passage with the second passage.

5. The dual-compartment bottle system of claim 4, wherein a cap aligning line is vertically secured to the lower portion of the threaded dispensing cap, and another corresponding cap aligning line is vertically secured to the upper portion of the cylindrical bottle so as to position the first and second passages with their respective first and second compartments when aligned.

6. The dual-compartment bottle system of claim 5, wherein the threaded dispensing cap includes a spring positioned pin near the top of the threaded dispensing cap projecting horizontally from within the semi-spherical cavity when the semi-spherical pivoting cap is pressed downwardly on one side, and where the spring positioned pin contains indicia of the fluid contained on the respective compartment and which springably projects back into the threaded dispensing cap upon closing the respective compartment, and where there is a corresponding spring positioned pin on the opposite side.

7. The dual-compartment bottle system of claim 6, wherein the cylindrical bottle is swaged forming an oblong shape.

8. A dual-compartment bottle system comprising:

a substantially cylindrical bottle including a vertical partition separating a first compartment and a second compartment which both dispense through a threaded neck of the cylindrical bottle; and a threaded dispensing cap rotatably secured to the threaded neck thereby selectively dispensing fluids from a desired compartment within the cylindrical bottle; and wherein the threaded dispensing cap includes an arcuate cavity projecting into a top of the threaded dispensing cap, a first passage projecting from the bottom surface into the arcuate cavity, and a second passage projecting from the bottom surface opposite of the first passage and then projecting into the arcuate cavity.

9. The dual-compartment bottle system of claim 8, wherein the threaded dispensing cap includes an arcuate pivoting cap formed to the shape of the arcuate cavity and where the arcuate pivoting cap is pivotally secured to the threaded dispensing cap within the arcuate cavity by an axle pin projecting through the upper portions of the threaded dispensing cap and the arcuate pivoting cap.

10. The dual-compartment bottle system of claim 9, wherein the threaded dispensing cap includes at least three positioning notches radially projecting into the wall of the arcuate cavity, and the arcuate pivoting cap includes a positioning member releasably captured by the positioning notches thereby positioning the arcuate pivoting cap flush to the top of the threaded dispensing cap or pivoted to either side about the axle pin.

11. The dual-compartment bottle system of claim 10, wherein the arcuate pivoting cap includes a first L-shaped passage projecting from one side of the central lower radial portion to the edge near the top of the threaded dispensing cap, and a second L-shaped passage projecting from the central lower radial portion opposite of the first L-shaped passage then projecting to the edge opposite of the first L-shaped passage near the top of the threaded dispensing cap, and where the first L-shaped passage receives fluid from the first compartment through the first passage when the arcuate pivoting cap is pivoted so as to align the first L-shaped passage with the first passage and where the second L-shaped passage receives fluid from the second compartment through the second passage when the arcuate pivoting cap is pivoted so as to align the second L-shaped passage with the second passage.

12. The dual-compartment bottle system of claim 11, wherein a cap aligning line is vertically secured to the lower portion of the threaded dispensing cap, and another corresponding cap aligning line is vertically secured to the upper portion of the cylindrical bottle so as to position the first and second passages with their respective first and second compartments when aligned.

13. The dual-compartment bottle system of claim 12, wherein the threaded dispensing cap includes a spring positioned pin near the top of the threaded dispensing cap projecting horizontally from within the arcuate cavity when the arcuate pivoting cap is pressed downwardly on one side, and where the spring positioned pin contains indicia of the fluid contained on the respective compartment and which springably projects back into the threaded dispensing cap upon closing the respective compartment, and where there is a corresponding spring positioned pin on the opposite side.

14. The dual-compartment bottle system of claim 13, wherein the cylindrical bottle is swaged forming an oblong shape.

15. A dual-compartment bottle system comprising:

a substantially cylindrical bottle including a vertical partition separating a first compartment and a second compartment which both dispense through a threaded neck of the cylindrical bottle; and a threaded dispensing cap rotatably secured to the threaded neck thereby selectively dispensing fluids from a desired compartment within the cylindrical bottle;

wherein the threaded dispensing cap includes an arcuate cavity projecting into a top of the threaded dispensing cap, a first passage projecting from the bottom surface into the arcuate cavity, and a second passage projecting from the bottom surface opposite of the first passage and then projecting into the arcuate cavity;

wherein the threaded dispensing cap includes an arcuate pivoting cap formed to the shape of the arcuate cavity and where the arcuate pivoting cap is pivotally secured to the threaded dispensing cap within the arcuate cavity by an axle pin projecting through the upper portions of the threaded dispensing cap and the arcuate pivoting cap;

wherein the threaded dispensing cap includes at least three positioning notches radially projecting into the wall of the arcuate cavity, and the arcuate pivoting cap includes a positioning member releasably captured by the positioning notches thereby positioning the arcuate pivoting cap flush to the top of the threaded dispensing cap or pivoted to either side about the axle pin;

wherein the arcuate pivoting cap includes a first L-shaped passage projecting from one side of the central lower radial portion to the edge near the top of the threaded dispensing cap, and a second L-shaped passage projecting from the central lower radial portion opposite of the first L-shaped passage then projecting to the edge opposite of the first L-shaped passage near the top of the threaded dispensing cap, and where the first L-shaped passage receives fluid from the first compartment through the first passage when the arcuate pivoting cap is pivoted so as to align the first L-shaped passage with the first passage and where the second L-shaped passage receives fluid from the second compartment through the second passage when the arcuate pivoting cap is pivoted so as to align the second L-shaped passage with the second passage;

wherein a cap aligning line is vertically secured to the lower portion of the threaded dispensing cap, and another corresponding cap aligning line is vertically secured to the upper portion of the cylindrical bottle so as to position the first and second passages with their respective first and second compartments when aligned;

wherein the threaded dispensing cap includes a spring positioned pin near the top of the threaded dispensing cap projecting horizontally from within the arcuate cavity when the arcuate pivoting cap is pressed downwardly on one side, and where the spring positioned pin contains indicia of the fluid contained on the respective compartment and which springably projects back into the threaded dispensing cap upon closing the respective compartment, and where there is a corresponding spring positioned pin on the opposite side; and wherein the cylindrical bottle is structured to form an oblong shape.

* * * * *